United States Patent [19]

Kitai et al.

[11] 4,209,969

[45] Jul. 1, 1980

[54] ALARM CLOCK

[75] Inventors: Kiyoshi Kitai; Masuo Ogihara; Kozo Chimura; Nobuo Shinozaki, all of Shikawatashi, Japan

[73] Assignee: Seiko Koki Kabushiki Kaisha, Tokyo, Japan

[21] Appl. No.: 877,824

[22] Filed: Feb. 15, 1978

[30] Foreign Application Priority Data

Mar. 25, 1977 [JP] Japan ..... 52-33583
Mar. 25, 1977 [JP] Japan ..... 52-33584
Mar. 25, 1977 [JP] Japan ..... 52-36850[U]

[51] Int. Cl.[2] ..... G04C 21/16; G04C 21/00

[52] U.S. Cl. ..... 368/250; 368/71; 368/259

[58] Field of Search ..... 58/16 R, 16 P, 19 R, 58/19 A, 21.15, 21.15 J, 38 R, 39.5, 125 R, 125 C, 126 C; 200/36, 37 R, 37 A, 38 R, 38 A, 38 FB, 38 C, 38 CA, 38 RA

[56] References Cited

U.S. PATENT DOCUMENTS

| | | | |
|---|---|---|---|
| 2,779,150 | 1/1957 | Chartier et al. | 58/16 |
| 3,996,734 | 12/1976 | Kitai et al. | 58/38 R |
| 4,000,384 | 12/1976 | Kumazawa | 200/37 R |
| 4,045,627 | 8/1977 | Kitai et al. | 200/37 R |
| 4,069,658 | 1/1978 | Ito | 58/16 R |
| 4,070,822 | 1/1978 | Arai | 58/38 R |
| 4,079,581 | 3/1978 | Kitai et al. | 58/21.15 J |

*Primary Examiner*—Vit W. Miska
*Attorney, Agent, or Firm*—Robert E. Burns; Emmanuel J. Lobato; Bruce L. Adams

[57] ABSTRACT

In a timepiece having a case and having a minute hand and an hour hand for indicating time, an alarm signaling device generates an alarm by detecting the phase of two sets of gears. One set of gears comprises an hour hand gear and an hour detecting gear and the other set comprises a minute hand gear and a minute detecting gear. The two sets of gears are concentrically mounted for rotation and the minute detecting gear is positioned between the minute gear and the one set of gears. The minute detecting gear has a contacting sliding contact with the minute gear. The alarm signaling device further includes an alarm signaling time setting wheel having an axis of rotation parallel to that of the two sets of gears and a first gear and a second gear engaging the minute detecting gear and the hour detecting gear respectively.

8 Claims, 8 Drawing Figures

ALARM CLOCK

BACKGROUND OF THE INVENTION

This invention relates to an alarm clock and more particularly to an alarm clock of the type wherein an alarm device is actuated at the simultaneous synchronization of phases of an hour unit gear and a minute unit gear, both provided for indicating time, with a preset alarm signaling time.

In a conventional alarm clock the usual method of actuating an alarm signaling device is to merely detect a phase of an hour unit gear, however, the method has the disadvantage that the alarm signaling time often deviates widely from a preset alarm signaling time due to the very slow rotation of the hour unit gear.

Another disadvantage of the conventional alarm clock, most of which are analog clocks, is that an alarm signaling time is rarely preset to the accuracy of a minute because of analog presetting of the alarm signaling time.

In order to overcome these disadvantages improvements have been made in which the preset alarm signaling time is indicated in digital values. However, the resulting improvements are unsatisfactory, because although the preset alarm signaling time is indicated to an accuracy of a minute, the alarm signaling time still deviates widely from the preset time as the detection of synchronization is performed only with respect to the hour unit gear as in the conventional method.

SUMMARY OF THE INVENTION

This invention provides an alarm clock in which those disadvantages are overcome.

Accordingly, a first object of the invention is to provide an alarm signaling time detecting mechanism, in combination with an hour unit gear and a minute unit gear.

A second object of the invention is to provide a digital alarm signaling time indicating mechanism.

The first object is attained by providing one manually operated alarm signaling time setting wheel for the purpose of adjusting to an optional time the phases of hour detecting and minute detecting gears, corresponding to and engaged with an hour unit gear and a minute unit gear, respectively.

Furthermore, friction coupling means is provided, within the gear train, engaging the minute unit gear with an electromechanical transducer in order to complete the improvement.

The second object is attained by providing a minute alarm signaling time indicating wheel and an hour alarm signaling time indicating wheel indicating minute place and hour place, respectively, and connecting the minute alarm signaling time indicating wheel with the alarm signaling time setting wheel by means of gears, and providing an intermittent driving means between the minute alarm signaling time indicating wheel and the hour alarm signaling time indicating wheel.

DETAILED DESCRIPTION OF THE PREFERRED EMBODIMENTS

Figure 1:
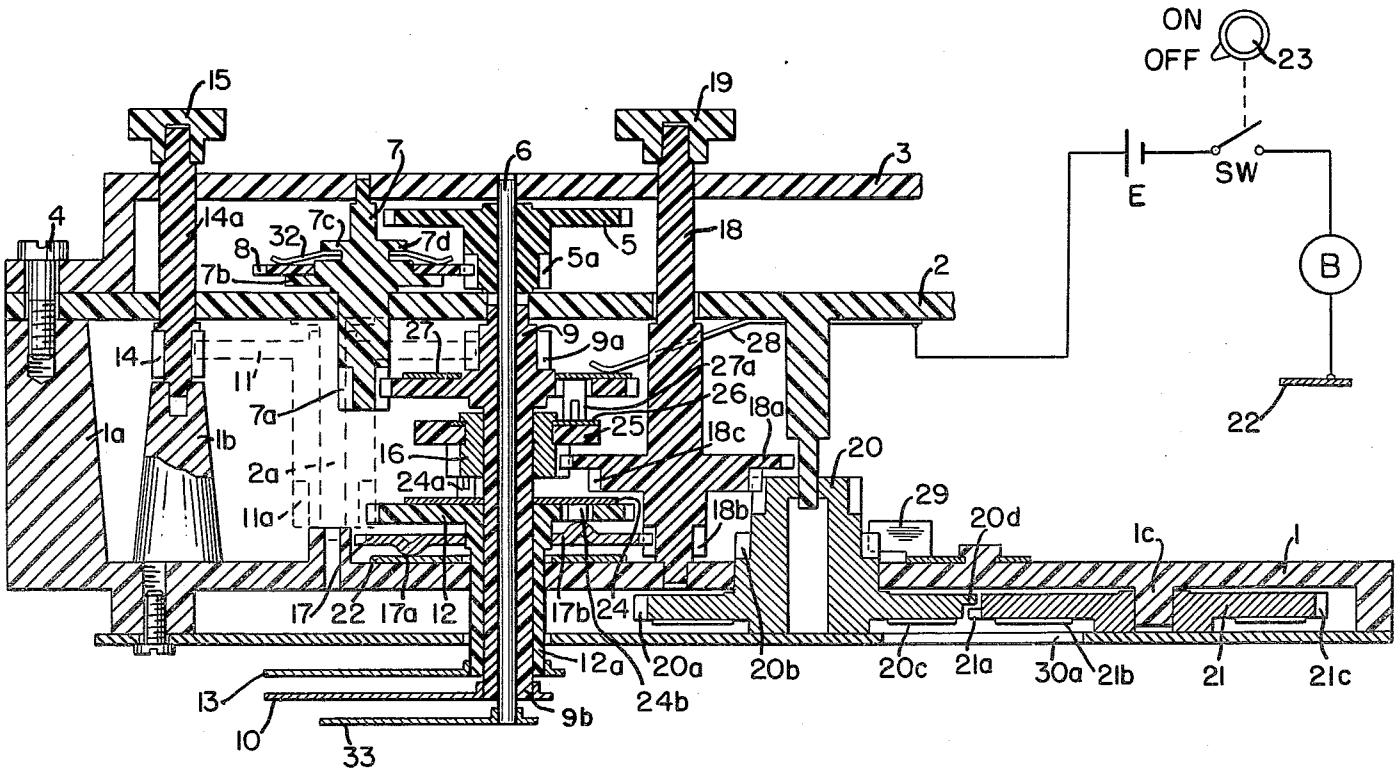
FIG. 1 is a sectional view of an alarm clock according to the present invention.

Other objects and advantages will become more fully apparent as reference is had to the accompanying drawings wherein embodiments are illustrated.

Referring now to FIGS. 1–4, the construction of a first embodiment will be explained.

A case (1) is formed of plastic material and provided with a projection (1*a*) having a threaded hole, a hole for rotatably guiding an extending boss (12*a*) of the hour hand gear (12), a hole for rotatably guiding an alarm signaling time setting wheel (18), a boss for supporting a spindle (2*a*) of an intermediate hour wheel (11), and a boss for supporting a spindle of a time adjusting gear (14).

A middle frame (2) is formed of plastic material having holes for rotatably guiding an intermediate spindle (7) and an upwardly extending boss 9*b* of the minute hand gear (9), idle holes through which an alarm signaling time setting wheel (18) and a spindle of time adjusting gear (14) and a shaft (2*a*) for rotatably mounting the intermediate hour wheel (11).

A cover (3) is formed of plastic material having holes for rotatably guiding a spindle (6) for mounting the second hand gear 5, the intermediate spindle (7), a spindle (14*a*) for mounting time adjusting gear 14 and alarm signaling time setting wheel (18).

The case (1), middle frame (2) and the cover (3) are assembled together and fastened at the projection (1*a*) by means of screws (4).

The second hand gear (5) and a pinion (5*a*) made of plastic material are formed in one body and fixed to spindle (6).

One end of the spindle (6) is rotatably supported by the extending boss (9*b*) of the minute hand gear 9 and at the tip of which the second hand (33) is fixed. The second hand gear (5) is driven by a motor, for instance a step motor, not shown.

The intermediate spindle (7) made of plastic material, is provided with a pinion (7*a*) in one body at its bottom end, a first flange (7*b*), a groove (7*c*) and a second flange (7*d*). The intermediate spindle (7) is rotatably guided by the cover (3) at its upper end and by the middle frame (2) at its middle part.

The intermediate gear (8) engages with the pinion (5*a*) of the second hand gear (5) and is rotatably mounted on the first flange (7*b*) by means of a leaf spring (32) held by the second flange (7*d*) thus forming a friction coupling with the intermediate spindle (7). The minute hand gear (9), made of plastic material, engages with the pinion (7*a*) mounted on the intermediate spindle 7, and is provided with a pinion (9*a*) and the extending boss (9*b*) in a body. The upper end of the extending boss (9*b*) is rotatably guided by the middle frame (2) and the other end penetrates through and is rotatably guided by the extending boss (12*a*) of the hour hand gear 12 and provided with the minute hand (10) at the tip.

The intermediate hour wheel (11) engaging with the pinion (9a) on the minute hand gear is made of plastic material and formed in one body with a pinion (11a) and rotatably mounted on the spindle (2a).

The hour hand gear (12) and the extending boss (12a) are made of plastic material and formed in one body so as to rotatably guide the extending boss (9b) of the minute hand gear through the bore and are pivoted by the hole on the case (1) and provided with the hour hand (13) at the end. The time adjusting gear (14) engages with the intermediate hour wheel (11) and its extending boss 14a is made of plastic material. The bottom end of the extending boss (14a) is pivoted by the hole of the projection (1b) of the case (1), while the upper end penetrates through the middle frame (2), is rotatably guided by the hole on the cover (3) and is fixedly provided with a time adjusting knob (15) at the tip.

The following explanation is related to the gear train of the alarm signaling mechanism.

A minute detecting gear (16) made of an electrically conductive material is rotatably mounted on the extending boss (9b) of the minute hand gear between the minute hand gear (9) and the hour hand gear (12). An hour detecting gear (17) made of electrically conductive material is rotatably mounted on the extending boss (12a) of the hour hand gear extending downwardly.

The alarm signaling time setting wheel (18), rotatably guided by the case (1) and the cover (3), has a first gear (18a) engaging with the minute detecting gear (16), a second gear (18b) engaging with the hour detecting gear (17) and a third gear (18c) engaging with the minute alarm signaling time indicating gear (20), is pivoted on the case (1) and is made of plastic material in one body.

The upper end of the alarm signaling time setting wheel (18) extends through the cover (3) and is provided with a alarm signaling time setting knob 19 at the end.

Figure 2:
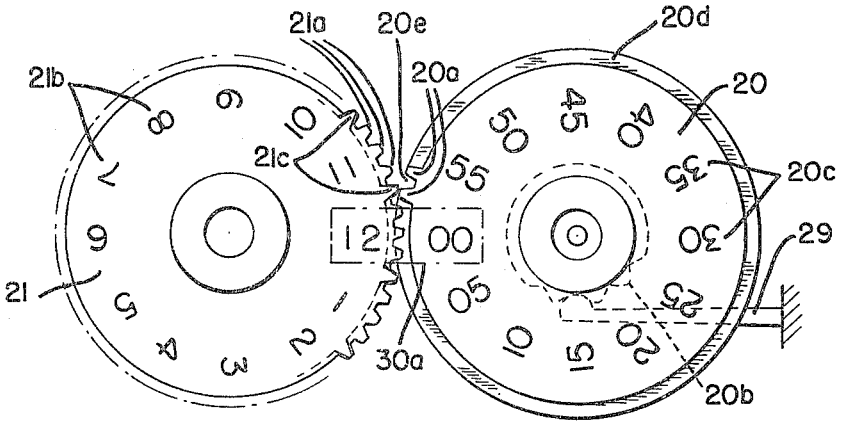
FIG. 2 is a plan view of a portion of the clock shown in FIG. 1.

Referring to FIGS. 1 and 2, the minute alarm signaling time indicating wheel (20) comprises a place advancing gear (20a), a disc (20d) provided with a recess (20e), alarm signaling time indicating marks (20c) in minutes graduation which can be observed through an alarm signaling time indicating opening (30a) and a click-stop gear (20b), the tooth number of which corresponds to the number of said marks. The minute alarm signaling time indicating wheel (20) is click stopped at every mark (20c) by the action of a spring (29) fixed to the case (1) on the clickstop gear (20b). An hour alarm signaling time indicating wheel (21) pivoted by the projection (1c) of the case (1) comprises, a gear (21a) capable of engaging with the place advancing gear (20a) on the minute alarm signaling time indicating wheel, a lost tooth gear (21c) capable of engaging with the disc (20d) and alarm signaling time indicating marks (21b) in hours graduation marked on the surface of said hour alarm signaling time indicating wheel.

Normally, the hour alarm signaling time indicating wheel (21) is restrained from rotation by the engagement of the lost tooth gear (21c) with the disc (20d). When the minute alarm signaling time indicating wheel changes from 55 minutes to 00 minute or from 00 minute to 55 minutes, the place advancing gear (20a) drives the hour alarm signaling time indicating wheel to turn an angle of thirty degrees.

In the abovementioned construction, the tooth numbers of the minute detecting gear (16): Z1, the first gear (18a): Z2, the second gear (18b): Z3, the hour detecting gear (17): Z4, the third gear (18c): Z5 and the minute alarm signaling time indicating gear (20a): Z6 are decided to satisfy the equation;

$$(Z2/Z1)\times(Z4/Z3)=12,\ (Z2/Z1)\times(Z6/Z5)=1$$

so that the alarm signaling time is set to an optional time by rotating the alarm signaling time setting knob 19. The tooth number of the click-stop gear (20b) is dependent on the graduation of the minute alarm signaling time indicating wheel six for graduation in ten minute intervals and twelve for graduation in five minute intervals.

The following explanation is related to the construction of the detecting switch for detecting the alarm signaling time.

One terminal of a buzzer (B) is connected to the minus terminal of a power source (E) through a manual switch (SW).

The switch (SW) is closed when the alarm signaling time setting knob (23) is rotated in order to set the alarm system.

The other terminal of the buzzer (B) is connected to a first stationary contact plate (22).

Figure 3:
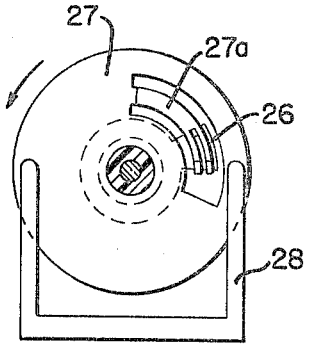
FIG. 3 is a plan view of the minute switch plate of FIG. 1.
Figure 4:
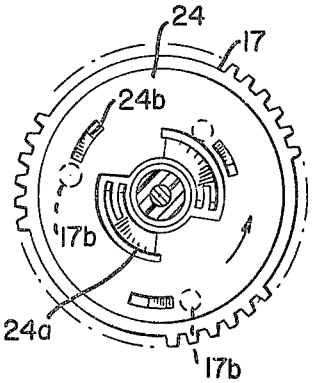
FIG. 4 is a plan view of the hour switch plate of FIG. 1.

Referring to FIGS. 1, 3 and 4, the first stationary contact plate (22) is disposed between the case (1) and the hour detecting gear (17). The downwardly extending boss of the hour hand gear extends through the center of the stationary contact plate (22).

The hour detecting gear (17) is made of electrically conductive material having on its bottom surface three first projections (17a) on a circle of a radius in equal intervals, and on its upper surface three second projections (17b) disposed on different radii but in equal angular intervals. The hour detecting gear (17) is supported horizontally by and electrically connected with the first stationary contact plate (22) by disposing it so that the first projections (17a) are in contact with the first stationary contact plate (22). An hour switch plate (24) is fixed on the upper surface of the hour hand gear (12) made of plastic material and disposed above the hour detecting gear (17). The hour switch plate (24) comprises an upwardly extending slide contact piece (24a) and three downwardly projecting projections (24b) disposed on different radii in equal angular intervals corresponding to the second projections (17b) on the hour detecting gear. The projections (17b) are designed so that the top end of each projection is almost flush with and sliding along the bottom surface of the hour hand gear (12). Normally, the switch plate (24) and the hour detecting gear are electrically disconnected and are electrically connected once in twelve hours for a given period of time by the contact of the projections (24b) and the second projections (17b).

The upwardly extending slide contact piece (24a) of the hour switch plate (24) is always in contact with the electrically conductive minute detecting gear (16). An insulating plate (25) and a sectoral switch plate (26) are piled and fastened together by caulking to the minute detecting gear (16) so that the minute detecting gear (16) and the sectoral switch plate (26) are electrically connected. On the minute hand gear (9) made of plastic, there is fixed a switch plate (27) having a slide contact piece (27a) extending downwardly through a hole on the flange of the minute hand gear (9) and making contact with the sectoral switch plate (26).

Normally, the slide contact plate (27*a*) slides along the surface of the insulating plate (25) so that the minute switch plate (27) and the sectoral contact plate (26) are electrically disconnected and are electrically connected once in an hour for a given period of time.

In the conventional clock, the abovementioned construction can not be practiced because, if the slide switch plate is fixed to the minute hand gear, the position of the slide switch plate relative to the minute hand will be shifted by time adjusting action since a friction coupling means is provided between the minute hand gear and its spindle in the conventional clock.

According to the invention, the relative positions of the minute switch plate (27) fixed to the minute hand gear and the minute hand (10) will not be shifted as the minute hand gear (9), the extending boss (9*b*) and the pinion (9*a*) are formed in one body.

On the middle frame (2), there is fixed a second stationary switch plate (28), one end of which is always in sliding contact with the upper surface of the switch plate (27) and the other end is connected to the plus terminal of the electric power source (E).

An additional explanation will now be made of the detecting mechanism. Although the alarm signaling time is indicated by a digital value, the phase of the hour detecting gear (17) changes analogically as the minute detecting gear (16) and the hour detecting gear (17) are directly engaged with the alarm signaling time setting wheel (18). Accordingly, an alarm signal is generated precisely on the preset time as long as the switch plate (24) and the hour detecting gear (17) are electrically connected for a period of time within an hour, for instance, for thirty minutes, even if it is so arranged that the minute switch plate (27) and the sectoral contact plate (26) are electrically connected for a given period of time, for instance, for five or ten minutes and also if the alarm signaling time is set at around the indication shifting time such as 55 minutes, because the hour detecting gear (17) moves analogically for the angle corresponding to 55 minutes.

The rotation of the alarm signaling time setting knob (19) is introduced to the minute alarm signaling time indicating gear (20) through the third gear (18*c*) fixed on the wheel (18) so that minute alarm signaling time marks (20*c*) are indicated by clickstopping in order for every five minutes as 5, 10, 15 and the like in the alarm signaling time indicating opening (30*a*). When the mark (20*c*) changes from 55 to 00 or from 00 to 55, the place advancing gear (20*a*) provided on the minute alarm signaling time indicating wheel and engaged with the hour alarm signaling time indicating wheel (21*a*) drives the hour alarm signaling time mark (21*b*), for instance, from 1 to 2 or from 1 to 12 depending upon the direction of rotation of the alarm signaling time setting knob (19). Thus the alarm signaling time can be set by watching the indication of the time on the alarm signaling time indicating marks (20*c*) and (21*b*). With the first gear (18*a*) fixed to the alarm signaling time setting spindle (18) and engaging with the minute detecting gear (16) and the second gear (18*b*) engaging with the hour detecting gear (17), the detecting gears (17) and (16) are rotated in compliance with the rotation of the spindle (18).

Accordingly, the relative position of the sectoral contact plate (26) fixed on the minute detecting gear (16) and the three second projections (17*b*) provided on the upper surface of the hour detecting gear (17) are determined at the same time with the alarm signaling time setting operation.

The alarm setting procedure is completed by turning the alarm setting knob to the ON-position to close the manual switch (SW).

In this initial state, the buzzer will not be actuated as the sectoral contact plate (26) and the slide contact plate (27*a*) of the minute switch plate, and the second projections (17*b*) of the hour detecting gear and the projections (24*b*) of the hour switch plate are disconnected.

The gear train of the time indicating mechanism is driven by a motor so that the minute hand gear (9) and the hour hand gear (12) are rotated one turn per hour and one turn per twelve hours, respectively. The switch plates (27) and (24) rotate with slide contacts 24*a* and 27*a* sliding on the surface of the minute detecting gear (16) and the hour detecting gear (17), respectively, urging those detecting gears to turn by frictional force. However, those detecting gears remain at their initial phases, being kept by the click-stop spring (29).

Although the sliding contact plate (27*a*) on the minute switch plate (27) comes in contact with the sectoral contact plate (26) once in an hour with the rotation of the minute hand gear (9), the buzzer will not be actuated as the hour switch plate (24) and the projections (17*b*) of the hour detecting gear (17) are not in contact at this moment. With the lapse of time, the projections (24*b*) of the hour switch plate (24) come in contact with the second projections (17*b*) of the hour detecting gear (17) in the first place.

The length of the projections (24*b*) is so designed that this contact is maintained for about twenty or forty minutes during which the sliding contact plate (27*a*) on the minute switch plate comes in contact with the sectoral contact plate (26), then the electric circuit comprising the first stationary contact plate (22)—the hour detecting gear (17)—the hour switch plate (24)—the minute detecting gear (16)—the sectoral contact plate (26)—the minute switch plate (27)—the second stationary contact plate (28), is connected so that the buzzer is actuated and alarm signal is generated.

The buzzer keeps buzzing as long as the sliding contact plate (27*a*) is in contact with the sectoral contact plate (26) unless the alarm setting switch (23) is turned off. The period of duration of buzzing can be determined by selectively deciding the length of the sectoral contact plate (26) independent of the alarm setting switch (23).

Adjustment of phases of the hour hand and the minute hand, that is, time adjustment, will now be explained.

The rotation of the time adjusting knob (15) in either direction is transmitted to the minute hand gear (9) and the hour hand gear (12) through the time adjusting gear (14) and the intermediate hour wheel (11).

During this adjustment, the minute detecting gear (16) and the hour detecting gear (17), as aforesaid, are kept at prefixed phases by the click-stop spring (29) engaged with the minute alarm signaling time indicating wheel (20). The rotation of the time adjusting knob (15) is transmitted further, by the friction couple comprising the leaf spring (32), to the intermediate gear (8), however, the intermediate gear (8) will not move as it is pulled in the reverse direction by a torque, introduced by the motor through the second hand gear (5), larger than the slip torque of the friction coupling.

Thus precise time adjustment is performed by rotating the time adjusting knob (15) in either direction and shifting the hour and the minute hand to any optional position.

Figure 5:
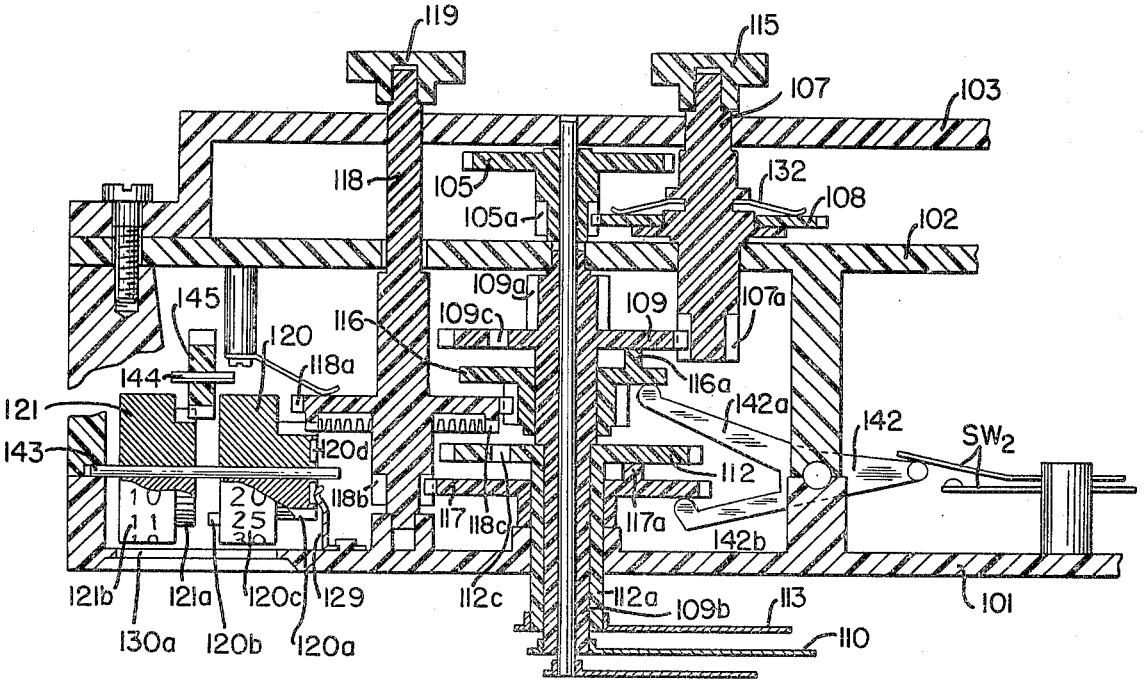
FIG. 5 is a sectional view of a second embodiment of an alarm clock according to the present invention.

Referring to FIG. 5, explanation will be made of a second embodiment of the invention regarding the gear train for the time indicating mechanism wherein explanation of the parts in common with the first embodiment will be omitted.

An intermediate gear (108) is engaged with a pinion (105*a*) formed in one body with the second hand gear (105) driven by a motor (not shown).

The intermediate gear (108) is rotatably mounted on a intermediate spindle (107) and coupled with a friction coupling comprising a leaf spring (132) as in the first embodiment.

On the bottom portion of the intermediate spindle (107), a pinion (107*a*) engaging with the minute hand gear (109) is provided. The upper portion is rotatably guided by and extends through a cover plate (103) and is provided with a time adjusting knob (115) at the top end. The minute hand gear (109) is fixedly provided with a pinion (109*a*) and the minute hand (110) at the bottom end of the extending boss (109*b*).

The pinion (109*a*) is engaged with an intermediate hour wheel, not shown, and one pinion formed in a body with the intermediate hour wheel is engaged with the hour hand gear (112). Time adjustment is carried out by directly rotating the time adjusting knob (115) fixed on the intermediate spindle (107). During the course of time adjustment, the intermediate gear (108) will not move as it is pulled in the reverse direction by a torque, introduced by the motor larger than the slip torque of the friction coupling so that the hour hand (113) and the minute hand (110) are adjusted to a correct time. The train for the alarm signaling mechanism of this embodiment will now be explained.

Similarly with the first embodiment, a minute detecting gear (116) is disposed between the minute hand gear (109) and hour hand gear (112) and an hour detecting gear (117) is disposed between a case (101) and the hour hand gear (112). The minute detecting gear (116) and the hour detecting gear (117) are rotatably mounted on the extending boss (109*b*) of the minute hand gear and on the extending boss (112*a*) of the hour hand gear (112), respectively.

The alarm signaling time setting wheel (118) is formed in one body with, a first gear (118*a*) engaging with the minute detecting gear (116), a second gear (118*b*) engaging with the hour detecting gear (117) and a face gear (118*c*) engaging with a minute alarm signaling time indicating drum (120). The minute alarm signaling time indicating drum (120) is rotatably mounted on a shaft (143) and provided with a gear (120*a*) engaging with the face gear (118*c*), a place advancing tooth (120*b*) and minute time indicating marks (120*c*) graduated in minutes which can be observed through an alarm signaling time indicating opening (130*a*). On one side of said drum (120) are provided grooves (120*d*) corresponding to the minute alarm signaling time marks so as to click-stop the drum (120) at every position corresponding to each minute alarm signaling time mark engaging with a spring (129) fixed to the case (1) at one end.

The place advancing gear (145) is rotatably mounted on a shaft (144) so as to engage with both the place advancing tooth (120*b*) of the minute alarm signaling time indicating drum 120 and a gear (121*a*) fixed to an hour alarm signaling time indicating drum (121). The hour alarm signaling time indicating drum (121) is rotatably mounted on the shaft (143) and provided on its surface with hour time indicating marks (121*b*) graduated in hours.

The hour alarm signaling time indicating drum (121) is driven intermittently by the minute alarm signaling time indicating drum 120.

An explanation will now be given with respect to the alarm signaling time detecting mechanism for this embodiment.

The minute hand gear (109) has a hole (109*c*) corresponding to a projection (116*a*) of the minute detecting gear (116) so that it is possible to set the projection (116*a*) into the hole (109*c*).

The hole (109*c*) and the projection (116*a*) are so shaped, as is well known for the type of mechanism, such that the projection (116*a*) falls into the hole (109*c*) along the vertical wall of the hole and goes out along the inclined wall of the hole according to the rotation of the minute hand wheel (109). The same mechanism is provided for the hour hand gear (112) and the hour detecting gear (117) having a hole (112*c*) and a projection (117*a*), respectively.

A detecting lever (142), rotatably supported by the middle frame (102) and the case plate (101), is engaged at the tip of one end with an elastic switch plate of a detecting switch (SW2) provided in the alarm signaling circuit, as in the first embodiment, normally keeping the switch (SW2) open and being elastically forced in the clockwise direction by the spring force of the elastic switch plate. The other end of the detecting lever (142) comprises a first arm (142*a*) and a second arm (142*b*) in contact with and forcing upwardly the bottom surface of the minute detecting gear (116) and the hour detecting gear (117), respectively.

The minute alarm signaling time indicating drum (120) is driven by the rotation of the alarm signaling time setting knob (119) against the braking force of the click-stop spring (129) through the face gear (118*c*) fixed on the alarm signaling time setting wheel (118). The minute alarm signaling time indicating marks (120*c*) appear in the alarm signaling time indicating opening (130*a*) click-stopping at every mark, such as 5, 10 and the like.

When the mark (120*c*) changes from 55 to 00 or from 00 to 55, the place advancing tooth (120*c*) of the minute alarm signaling time indicating drum (120) engages with the place advancing gear (145) so that the hour alarm signaling time indicating drum (121) is rotated for an angle of thirty degrees, which corresponds to the change of one hour on the indicator. The rotation of the alarm signaling time setting wheel (118) is transmitted to the minute detecting gear (116) and the hour detecting gear (117) through the first gear (118*a*) and the second gear (118*b*) as in the first embodiment. In such a mechanism, the alarm signaling time can be set to an optional time while watching the alarm signaling time setting marks. The minute detecting gear and the hour detecting gear are not shifted vertically, keeping the lever (142) at the position shown in the drawing, until the phases of the minute hand gear and the hour hand gear are synchronized simultaneously with the preset alarm signaling time.

The minute hand gear (109) and the hour hand gear (112) rotate one turn per hour and one turn per twelve hours, respectively.

The phases of the hole (109*c*) on the minute hand gear and the projection (116*a*) on the minute detecting gear are synchronized with each other at least once in an hour, however, the buzzer (B) will not buzz as the phases of the hole (112c) on the hour hand gear and the projection (117a) on the hour detecting gear have not yet been synchronized with each other. With the lapse of time, in the first place, the phases of the hole (112c) on the hour hand gear and the projection (117a) on the hour detecting gear are synchronized, however, the detecting lever (142) cannot turn yet because the minute hand gear has not reached the preset alarm signaling time and the phase of the hole (109c) and the projection on the minute detecting gear has not been synchronized.

With the further lapse of time, with the projection (117a) on the hour detecting gear and the hole (112c) on the hour hand gear synchronized, the phase of the projection (116a) on the minute detecting gear (116) and the hole (109c) on the minute hand gear are synchronized, then the projection (116a) and (117a) falling into the corresponding holes (109c) and (112c), the detecting lever (142) is turned in the direction to close the detecting switch (SW2) so that the buzzer (B) is actuated. Buzzing can be stopped by turning off the alarm setting switch. With further rotation of the minute hand gear (109) from the synchronized state, the minute alarm signaling time detecting gear (116) is depressed downwardly by the engagement of the inclined wall of the hole (109c) of the minute hand gear and the inclined surface of the projection (116a) of the minute alarm signaling time detecting gear to that said detecting lever (142) is turned in the direction to turn off the detecting switch (SW2). Time Adjustment of the mechanism of this embodiment is explained as follows.

The rotation of the time adjusting knob (115) is transmitted to the minute hand gear (109) through the pinion (107a) fixed on the intermediate spindle (107) and further to the hour hand gear (112) through an intermediate hour wheel (not shown).

On the other hand, said rotation introduces a torque to the intermediate gear (108) by the friction coupling, however, the intermediate gear (108) will not move as it is retained by the torque introduced from the motor which is larger than that of the friction coupling as in the first embodiment.

Figure 6:
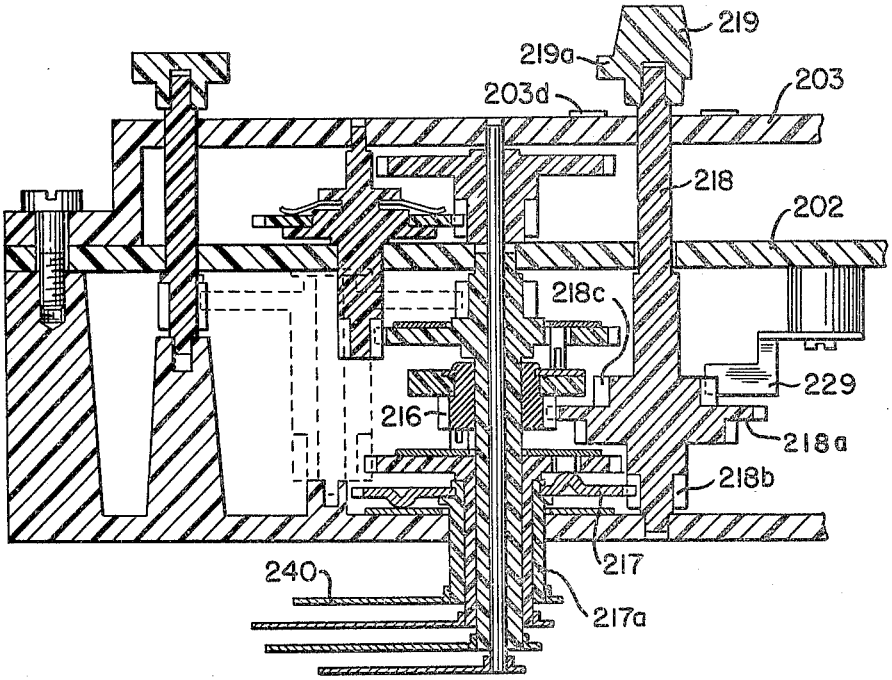
FIG. 6 is a sectional view of a third embodiment of an alarm clock according to the present invention.
Figure 7:
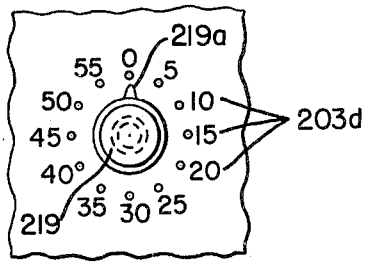
FIG. 7 is a plan view of a detail of FIG. 6.

Referring now to FIGS. 6 and 7, an explanation will be made of a third embodiment of the invention. The explanation will be limited to those parts which are different from the first embodiment as this embodiment is very similar to the first embodiment.

Explanation will be omitted with respect to the gear train for the time adjusting mechanism as it is quite similar to that of the first embodiment.

Concerning the alarm signaling mechanism, the alarm signaling time is indicated by a digital value in the first embodiment.

According to this embodiment, it is indicated analogically by an indicating needle (240) fixed at the end of a tube (217a) fixed on an hour signaling time detecting gear (217).

An alarm signaling time setting wheel 218 including, a first gear (218a) engaging with a minute alarm signaling time detecting gear (216) and a second gear (218b) engaging with said hour alarm signaling time detecting gear (217) are formed in one body as in the first embodiment. Furthermore, a click-stop gear (218c), functioning the same as that provided on a minute alarm signaling time indicating gear in the first embodiment, is also formed in one body with the alarm signaling time setting wheel (218).

The click-stop gear (218c), engages with a spring (229) fixed to a middle frame at one end, and click-stops said wheel (218) at a regular interval, for instance, at every minute indicating mark such as 0, 5, 10 and the like. The wheel (218), extending through the middle frame and a cover plate is provided with an alarm signaling time setting knob (219) at the end. The alarm signaling time setting knob has a projection (219a) related to marks (203d) marked corresponding to the aforesaid click-stop intervals and indicating the minute place of the alarm signaling time.

In setting an alarm signaling time, the hour place is adjusted by watching the indicating needle (240) and more precisely is adjusted the minute place by setting the projection (219a) to an optional minute mark (203d) marked on the cover.

Explanation will be omitted with a gear train for the alarm signaling mechanism and the alarm signaling time detecting mechanism as they are quite the same as those of the first embodiment.

Figure 8:
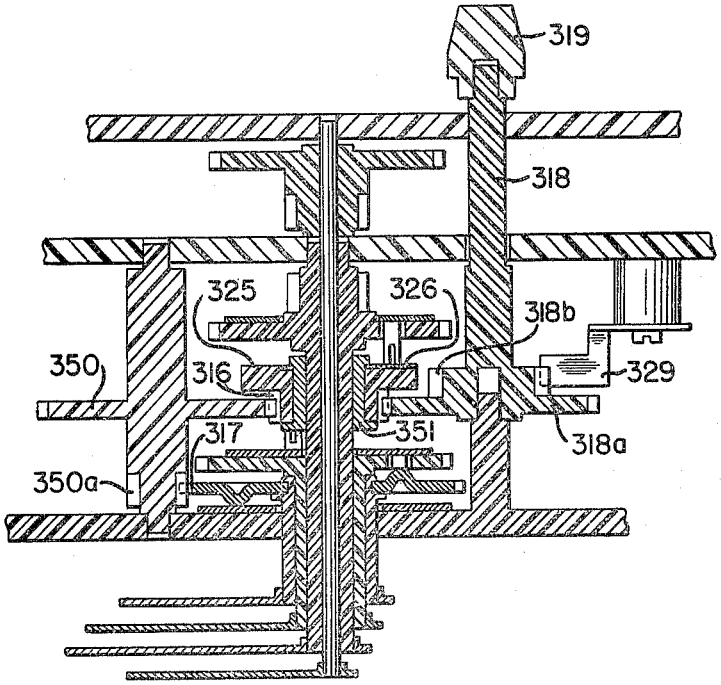
FIG. 8 is a sectional view of a fourth embodiment of an alarm clock according to the present invention.

Referring to FIG. 8, and explanation will be made concerning the fourth embodiment. An explanation will be omitted of the gear train for the time indicating mechanism and the mechanism of the alarm signaling time detecting switch as they are the same as those of the third embodiment. Explanation will be made only of the gear train for the alarm signaling mechanism which differs from those of the other embodiments.

A gear (318a) engaged with a minute detecting gear (316) and a click-stop gear (318b) engaging with a click-stop spring (329) are fixed on an alarm signaling time setting spindle (318).

The minute detecting gear (316) and an insulating plate (325) are formed in one body of plastic material and through the center of which an electric conducting tube (351) made of an electrically conductive material is set in. A sectoral contact plate disposed on the insulating plate (325) and the electric conducting tube (351) are electrically connected by being fastened by caulking.

An intermediate gear (350) and a pinion (350a) are formed in one body engaging with the minute detecting gear (316) and the hour detecting gear (317), respectively. The rotation of the knob (319) of the alarm signaling time setting wheel (318) is transmitted in the order of the gear (318a)—the minute detecting gear (316)—the intermediate gear (350)—the pinion (350a)—the hour detecting gear (317).

An explanation will be omitted of the other mechanisms as they are the same as those of the third embodiment.

As explained above, the aforesaid objects are attained by the present invention, and furthermore, the technical effect is succeeds in making it possible to reduce the load on the electromechanical transducer of a battery clock and also possible to turn either knobs in the optional direction, in the right or left, in adjusting time or in setting an alarm signaling time due to the simple construction of the slide switching type detecting mechanism.

We claim:

1. In a timepiece having a case, an alarm signaling device for generating an alarm by detecting the phase of two sets of gears and at least a minute hand and an hour hand for indicating the time at which the alarm signaling device is effected to generate the alarm, the improvement wherein the two sets of gears are concentrically mounted for rotation and one set of gears comprises an hour hand gear and an hour detecting gear and the other set comprises a minute hand gear and a minute detecting gear positioned between the minute gear and the one set of gears and having means in sliding contact with the minute gear, and further comprising an alarm signaling time setting device comprising an alarm signaling time setting wheel having an axis of rotation parallel to that of the two sets of gears and a first gear and a second gear engaging with said minute detecting gear and said hour detecting gear respectively.

2. The alarm signaling time setting device as set forth in claim 1, further comprising braking means acting upon said alarm signaling time setting wheel to prevent rotation thereof.

3. The alarm signaling time setting device as set forth in claim 2, further comprising a knob fixed to one end of said alarm signaling time setting wheel, alarm signaling time marks graduated in minutes and an index corresponding to said alarm signaling time marks, wherein one of the index and the marks is disposed on the case and the other is disposed on the knob.

4. The device according to claim 2, wherein the braking means comprises a click-stop spring.

5. The device according to claim 2, wherein the braking means comprises a friction member.

6. In a timepiece having an alarm signaling device for generating an alarm by detecting the phase of two sets of gears and at least a minute hand and an hour hand for indicating the time at which the alarm signaling device is effected to generate the alarm, the improvement wherein the two gear sets are concentrically mounted for rotation and one set comprises an hour hand gear and an hour detecting gear and the other set comprises a minute hand gear and a minute detecting gear, and further comprising a digital minute-alarm signaling time indicating wheel, a digital hour-alarm signaling time indicating wheel, an intermittent driving device connecting the two indicating wheels, and an alarm signaling time setting device comprising an alarm signaling time setting wheel having gears engaging with said minute detecting gear, said hour detecting gear and said minute-alarm signaling time indicating wheel.

7. The alarm signaling time setting device as set forth in claim 6, wherein said alarm signaling time indicating wheels comprise discs and wherein the intermittent driving device comprises a gear and a lost tooth gear on the circumference of said hour-alarm signaling time indicating wheel and on the circumference of said minute-alarm signaling time indicating wheel, a place advancing gear capable of engaging with said gear on the hour-alarm signaling time indicating wheel and a disc capable of engaging with said lost tooth gear.

8. The alarm signaling time setting device as set forth in claim 6, wherein said alarm signaling time indicating wheels comprise drums and wherein said minute-alarm signaling time indicating wheel has a gear on its side and said alarm signaling time setting wheel has a face gear in engagement therewith.

* * * * *